US009512681B1

(12) United States Patent
Mukhopadhyay

(10) Patent No.: US 9,512,681 B1
(45) Date of Patent: Dec. 6, 2016

(54) POLYCRYSTALLINE DIAMOND COMPACT COMPRISING CEMENTED CARBIDE SUBSTRATE WITH CEMENTING CONSTITUENT CONCENTRATION GRADIENT

(71) Applicant: US SYNTHETIC CORPORATION, Orem, UT (US)

(72) Inventor: Debkumar Mukhopadhyay, Sandy, UT (US)

(73) Assignee: US SYNTHETIC CORPORATION, Orem, UT (US)

( * ) Notice: Subject to any disclaimer, the term of this patent is extended or adjusted under 35 U.S.C. 154(b) by 429 days.

(21) Appl. No.: 14/081,960

(22) Filed: Nov. 15, 2013

Related U.S. Application Data

(60) Provisional application No. 61/727,841, filed on Nov. 19, 2012.

(51) Int. Cl.
*E21B 10/42* (2006.01)

(52) U.S. Cl.
CPC ..... *E21B 10/42* (2013.01)

(58) Field of Classification Search
USPC ..... 175/434, 428, 426
See application file for complete search history.

(56) References Cited

U.S. PATENT DOCUMENTS 4,268,276 A 5/1981 Bovenkerk
4,410,054 A 10/1983 Nagel et al.
4,468,138 A 8/1984 Nagel
4,560,014 A 12/1985 Geczy
4,738,322 A 4/1988 Hall et al.
4,811,801 A 3/1989 Salesky et al.
4,913,247 A 4/1990 Jones
5,016,718 A 5/1991 Tandberg
5,092,687 A 3/1992 Hall
5,120,327 A 6/1992 Dennis
5,135,061 A 8/1992 Newton, Jr.
5,154,245 A 10/1992 Waldenstrom
5,180,022 A 1/1993 Brady
5,364,192 A 11/1994 Damm et al.
5,368,398 A 11/1994 Damm et al.
5,460,233 A 10/1995 Meany et al.
5,480,233 A 1/1996 Cunningham
5,492,188 A 2/1996 Smith et al.

(Continued)

OTHER PUBLICATIONS

U.S. Appl. No. 61/727,841, filed Nov. 19, 2012, Mukhopadhyay.

(Continued)

*Primary Examiner* — Taras P Bemko
(74) *Attorney, Agent, or Firm* — Dorsey & Whitney LLP

(57) ABSTRACT

In an embodiment, a polycrystalline diamond compact includes a cemented carbide substrate including a carbide constituent cemented with a cementing constituent. The cementing constituent has a non-homogenous concentration within the substrate that includes a substantially continuous gradient. A first portion (e.g. at or near a center) of the substrate has a concentration of the cementing constituent that differs from a concentration of the cementing constituent at a second portion (e.g., at or near an outer surface) of the substrate. Thus, the concentration gradient exhibits a substantially smooth gradient, with increasing distance from the first portion of the substrate towards the second portion of the substrate. This provides the substrate with relatively higher wear resistance in one region (e.g., at or near the outer surface) and relatively higher toughness in another region (e.g., at or near the center).

17 Claims, 14 Drawing Sheets

(56) References Cited

U.S. PATENT DOCUMENTS

| | | | | |
|---|---|---|---|---|
| 5,544,713 | A | 8/1996 | Dennis | |
| 6,216,805 | B1 | 4/2001 | Lays et al. | |
| 6,220,375 | B1 | 4/2001 | Butcher et al. | |
| 6,793,681 | B1 | 9/2004 | Pope et al. | |
| 6,872,356 | B2 | 3/2005 | Butcher et al. | |
| 7,866,418 | B2 | 1/2011 | Bertagnolli et al. | |
| 2009/0046967 | A1 * | 2/2009 | Pope | A61F 2/30767 384/492 |
| 2009/0152018 | A1 * | 6/2009 | Sani | B21C 3/02 175/432 |
| 2011/0256347 | A1 * | 10/2011 | Manuad | C23C 16/0272 428/143 |
| 2013/0133957 | A1 | 5/2013 | Belnap et al. | |

OTHER PUBLICATIONS

U.S. Appl. No. 13/648,913, filed Oct. 10, 2012, Mukhopadhyay et al.

Fan et al., "Design of cobalt gradient via controlling carbon content and WC grain size in liquid-phase-sintered WC—Co composite", Int. Journal of Refractory Metals & Hard Materials 27 (2009) pp. 256-260.

Fan et al., "Effects of Liquid-Phase Composition on its Migration during Liquid-Phase Sintering of Cemented Carbide", The Mineral, Metal & Materials Society and ASM International, Metallurgical and Materials Transactions A vol. 40A, Aug. 2009.

* cited by examiner

POLYCRYSTALLINE DIAMOND COMPACT COMPRISING CEMENTED CARBIDE SUBSTRATE WITH CEMENTING CONSTITUENT CONCENTRATION GRADIENT

CROSS-REFERENCE TO RELATED APPLICATIONS

This application claims priority to U.S. Provisional Application No. 61/727,841 filed on 19 Nov. 2012, the disclosure of which is incorporated herein, in its entirety, by this reference.

BACKGROUND

Wear-resistant, polycrystalline diamond compacts ("PDCs") are utilized in a variety of mechanical applications. For example, PDCs are used in drilling tools (e.g., cutting elements, gage trimmers, etc.), machining equipment, bearing apparatuses, wire-drawing machinery, and in other mechanical apparatuses.

PDCs have found particular utility as superabrasive cutting elements in rotary drill bits, such as roller-cone drill bits and fixed-cutter drill bits. A PDC cutting element typically includes a superabrasive diamond layer commonly known as a diamond table. The diamond table is formed and bonded to a substrate using a high-pressure/high-temperature ("HPHT") process. The PDC cutting element may also be brazed directly into a preformed pocket, socket, or other receptacle formed in a bit body. The substrate may often be brazed or otherwise joined to an attachment member, such as a cylindrical backing. A rotary drill bit typically includes a number of PDC cutting elements affixed to the bit body. It is also known that a stud carrying the PDC may be used as a PDC cutting element when mounted to a bit body of a rotary drill bit by press-fitting, brazing, or otherwise securing the stud into a receptacle formed in the bit body.

Conventional PDCs are normally fabricated by placing a cemented carbide substrate into a container with a volume of diamond particles positioned on a surface of the cemented carbide substrate. A number of such containers may be loaded into an HPHT press. The substrate(s) and volume of diamond particles are then processed under HPHT conditions in the presence of a catalyst material that causes the diamond particles to bond to one another to form a matrix of bonded diamond grains defining a polycrystalline diamond ("PCD") table. The catalyst material is often a metal-solvent catalyst (e.g., cobalt, nickel, iron, or alloys thereof) that is used for promoting intergrowth of the diamond particles.

In one conventional approach, a constituent of the cemented carbide substrate, such as cobalt from a cobalt-cemented tungsten carbide substrate, liquefies and sweeps from a region adjacent to the volume of diamond particles into interstitial regions between the diamond particles during the HPHT process. The cobalt acts as a catalyst to promote intergrowth between the diamond particles, which results in formation of a matrix of bonded diamond grains having diamond-to-diamond bonding therebetween, with interstitial regions between the bonded diamond grains being occupied by the solvent catalyst.

Despite the availability of a number of different PDCs, manufacturers and users of PDCs continue to seek PDCs that exhibit improved toughness, wear resistance, and/or thermal stability.

SUMMARY

Embodiments of the invention relate to PDCs including a PCD table and a cemented carbide substrate in which the cementing constituent (e.g., cobalt, nickel, iron, or alloys thereof) exhibits a substantially continuous concentration gradient such that a first portion of the substrate (e.g., at or near a center of the substrate) has a different cementing constituent concentration than a second portion (e.g., at or near an outer lateral surface) of the substrate. The concentration gradient may be substantially continuous so that no abrupt change in concentration occurs, but that the concentration gradient smoothly increases or decreases with increasing distance from the first portion to the second portion. Providing relatively lower cementing constituent concentration in one portion (e.g., at or near the outer surface of the substrate) provides increased hardness and wear resistance to this portion relative to another portion with higher cementing constituent concentration. The higher cementing constituent concentration provides increased toughness to this corresponding portion. For example, it may be desirable to provide increased toughness at or near the center of the substrate, while providing increased wear resistance at or near the outer lateral surface of the substrate. Characteristics that can be so tailored through manipulation of the concentration gradient of the cementing constituent include, but are not limited to, toughness, wear resistance, abrasion resistance, erosion resistance, corrosion resistance, and thermal stability. The PDC further includes a PCD table bonded to the cemented carbide substrate. The PCD table includes a plurality of bonded diamond grains exhibiting diamond-to-diamond bonding therebetween and defining a plurality of interstitial regions.

In an embodiment, the PDC may be employed within a rotary drill bit including a bit body having a leading end structure configured to facilitate drilling a subterranean formation, and a plurality of cutting elements mounted to the bit body. At least one of the cutting elements may include a cemented carbide substrate including a carbide constituent cemented with a cementing constituent having a concentration within the substrate that has a substantially continuous gradient so that a first portion (e.g., at or near a center) of the substrate has a concentration that differs from a concentration of the cementing constituent at a second portion (e.g., at or near an outer lateral surface) of the substrate. The concentration gradient is substantially continuous, so that the concentration gradient smoothly advances from one portion to the other, without any abrupt changes in concentration. The cutting element further includes a PCD table bonded to the substrate. The PCD table includes a plurality of diamond grains exhibiting diamond-to-diamond bonding therebetween. The plurality of diamond grains define a plurality of interstitial regions. In addition to rotary drill bits, the disclosed PDCs may be employed in other various articles and apparatuses, including, but not limited to bearing apparatuses, wire-drawing dies, machining equipment, and other articles and apparatuses.

In an embodiment, a method of manufacturing a PDC including a substrate having a concentration gradient through the substrate with respect to the cementing constituent concentration may be achieved through sintering of a substrate assembly comprising first and second portions, each portion including a carbide constituent and a cementing constituent. The first portion has at least one of a different carbide constituent grain size or a different carbon content relative to the second portion. Upon sintering, the cementing constituent tends to migrate from a region of larger carbide grain size to a region of smaller carbide grain size. Similarly, upon sintering, the cementing constituent tends to migrate from a region of higher carbon content to a region of lower carbon content.

Features from any of the disclosed embodiments may be used in combination with one another, without limitation. In addition, other features and advantages of the present disclosure will become apparent to those of ordinary skill in the art through consideration of the following detailed description and the accompanying drawings.

BRIEF DESCRIPTION OF THE DRAWINGS

The drawings illustrate several embodiments of the invention, wherein identical reference numerals refer to identical or similar elements or features in different views or embodiments shown in the drawings.

DETAILED DESCRIPTION

Embodiments of the invention relate to PDCs including a PCD table and a cemented carbide substrate in which the cementing constituent exhibits a substantially continuous concentration gradient through the substrate so that one portion (e.g., at or near a center) of the substrate has a concentration that differs from another portion (e.g., at or near an outer lateral surface) of the substrate. In an embodiment, the concentration gradient may smoothly advance from the one portion to the other, without any abrupt changes or steps in concentration. For example, in an embodiment, the concentration of a cementing constituent may be greatest at or near the center of the substrate, while it gradually decreases with increasing radial distance from the center towards the outer lateral surface of the substrate. The PDCs disclosed herein may be used in a variety of applications, such as rotary drill bits, bearing apparatuses, wire-drawing dies, machining equipment, and other articles and apparatuses.

Figure 1A:
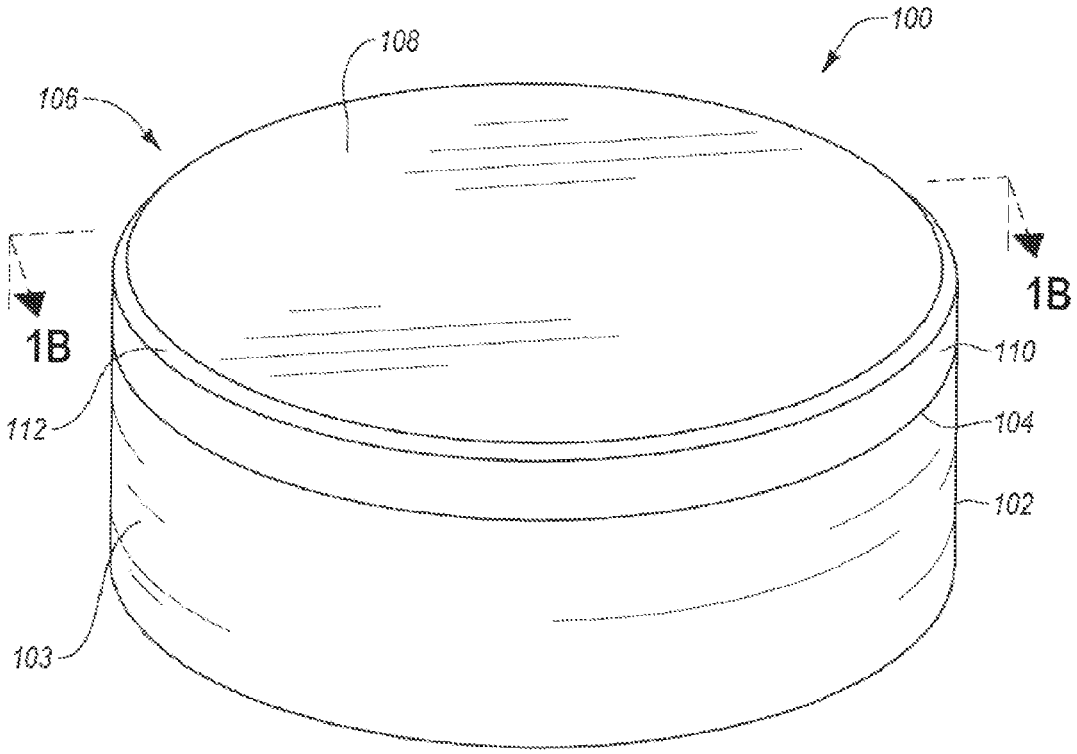
FIG. 1A is an isometric view of an embodiment of a PDC.
Figure 1B:
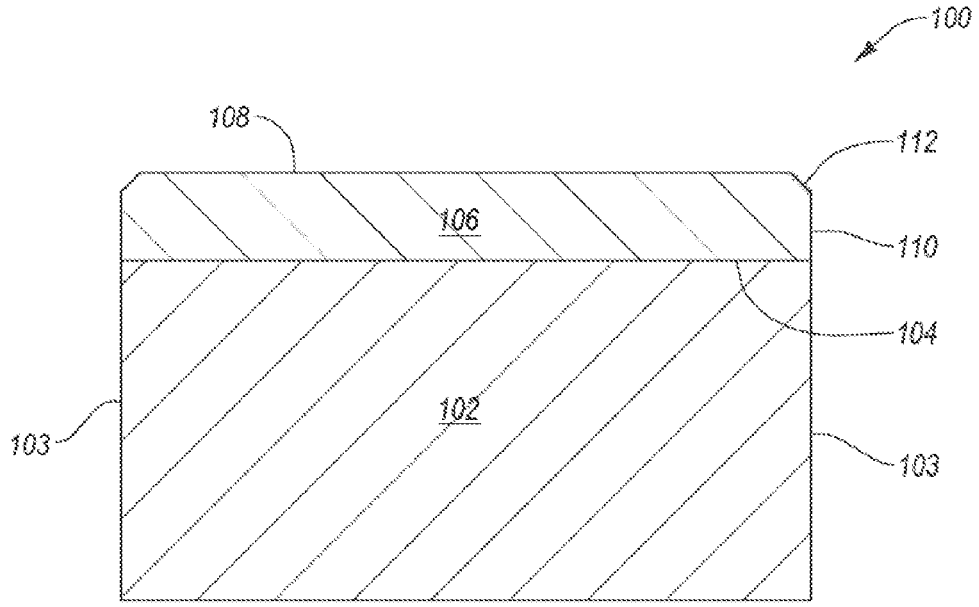
FIG. 1B is a cross-sectional view of the PDC shown in FIG. 1A taken along line 1B-1B thereof.

FIGS. 1A and 1B are isometric and cross-sectional views, respectively, of a PDC 100 according to an embodiment. The PDC 100 includes a cemented carbide substrate 102 including carbide constituent grains (e.g., grains of tungsten carbide, titanium carbide, chromium carbide, niobium carbide, tantalum carbide, vanadium carbide, or combinations thereof) cemented with a metallic cementing constituent, such as cobalt, nickel, iron, or alloys thereof. For example, in an embodiment, the substrate 102 includes cobalt-cemented tungsten carbide. The cemented carbide substrate 102 includes an outer lateral surface 103 and an interfacial surface 104 between substrate 102 and PCD table 106. In the illustrated embodiment, the cross-section of the interfacial surface 104 is substantially straight line. In other embodiments, a cross-section of the interfacial surface 104 may be arcuate, oscillating, variable, or otherwise configured as may be exhibited by a planar or non-planar interface. Generally, the interfacial surface 104 may exhibit a selected planar or non-planar topography.

The PDC 100 further includes a PCD table 106 bonded to the interfacial surface 104 of the cemented carbide substrate 102. The PCD table 106 includes a plurality of directly bonded-together diamond grains exhibiting diamond-to-diamond bonding therebetween (e.g., $sp^3$ bonding). The plurality of directly bonded-together diamond grains defines a plurality of interstitial regions. The PCD table 106 may include a metal-solvent catalyst or infiltrant (e.g., iron, nickel, cobalt, or alloys thereof) that may be disposed in at least a portion of the interstitial regions, e.g., which was infiltrated from the cemented carbide substrate 102. In an embodiment, the PCD table 106 may be integrally formed with (i.e., formed from diamond powder sintered on) the cemented carbide substrate 102. In another embodiment, the PCD table 106 may be a preformed PCD table that is bonded to the cemented carbide substrate 102 in an HPHT bonding process.

The PCD table 106 includes a working, upper surface 108, at least one lateral surface 110, and an optional chamfer 112 extending therebetween. However, it is noted that all or part of the at least one lateral surface 110 and/or the chamfer 112 may also function as a working surface. In the illustrated embodiment, the PDC 100 has a cylindrical geometry, and the upper surface 108 exhibits a substantially planar geometry. However, in other embodiments, the PDC 100 may exhibit a non-cylindrical geometry and/or the upper surface 108 of the PCD table 106 may be nonplanar, such as convex or concave.

Figure 2:
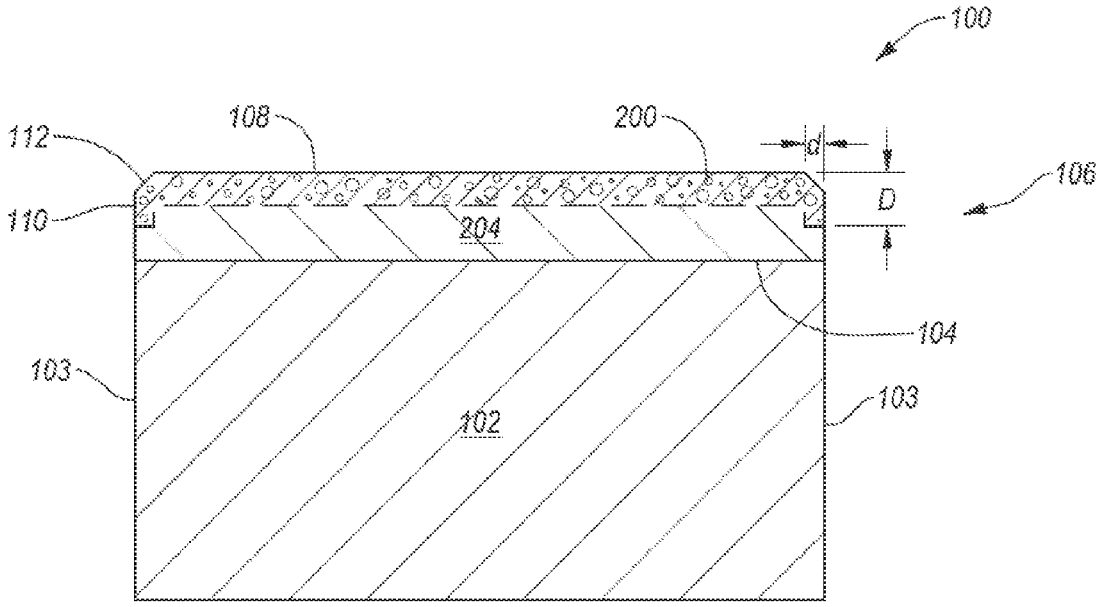
FIG. 2 is a cross-sectional view of the PDC shown in FIG. 1B after leaching a region of the PCD table that is remote from the cemented carbide substrate according to an embodiment.

FIG. 2 is a cross-sectional view of an embodiment of the PDC 100 after a selected portion of the PCD table 106 has been leached to at least partially remove metal-solvent catalyst or infiltrant therefrom. Leaching may be achieved by exposure of one or more surfaces of the PCD table 106 to a suitable acid (e.g., nitric acid, hydrochloric acid, hydrofluoric acid, aqua regia or mixtures thereof) for a suitable period of time. In an embodiment, exposure to a leaching acid may be from about 12 hours to about 7 days, about 2 days to about 7 days, about 3 days, about 5 days, about 7 days, or for several weeks (e.g., about 4 weeks). After such leaching treatment, the PCD table 106 may include a leached region 200 that extends inwardly from the upper surface 108 to a selected depth D. The leached region 200 may also extend inwardly from the at least one lateral surface 110 to a selected distance d. The leached region 200 may extend along any desired edge geometry (e.g., the chamfer 112, a radius, etc.) and/or the lateral surface 110, as desired. The PCD table 106 may further include a region 204 that is relatively unaffected by the leaching process. In some embodiments, the distance d may be about equal to the depth D. The depth D and/or distance d may be about 10 μm to about 1000 μm, such as about 10 μm to about 500 μm, about 20 μm to about 150 μm, about 30 μm to about 90 μm, about 20 μm to about 75 μm, about 200 μm to about 300 μm, or about 250 μm to about 500 μm.

Figure 3:
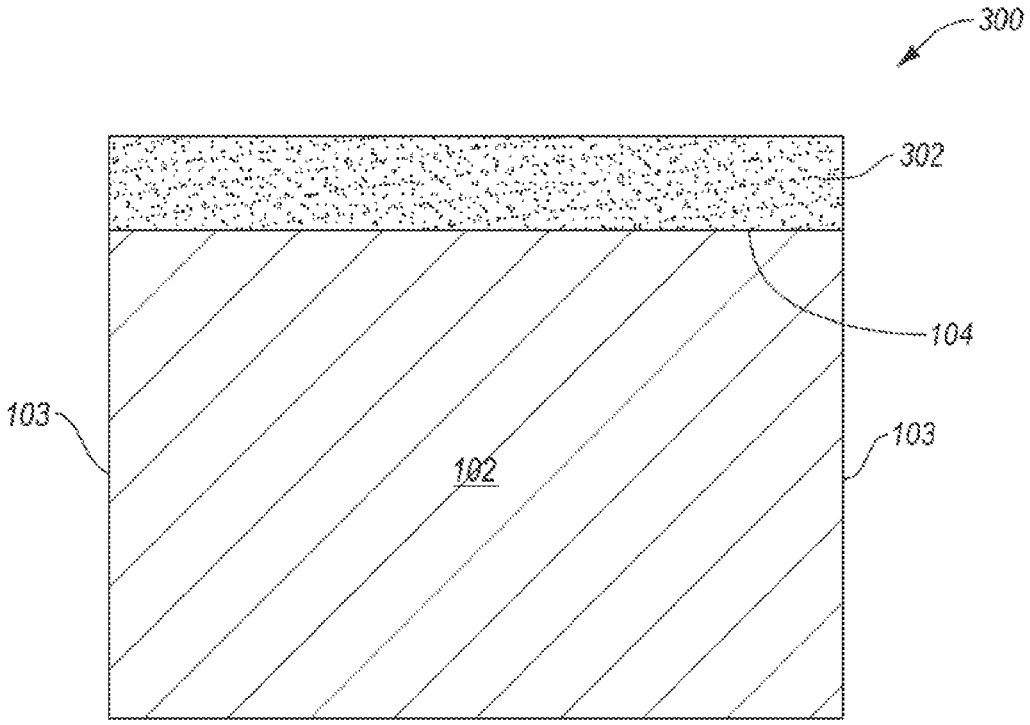
FIG. 3 is a cross-sectional view of an assembly to be HPHT processed to form the PDC shown in FIGS. 1A and 1B according to an embodiment.

FIG. 3 is a cross-sectional view of an assembly 300 to be HPHT processed to form the PDC shown in FIGS. 1A and 1B according to an embodiment. Assembly 300 includes cemented carbide substrate 102 and at least one layer 302 of diamond particles. As will be described in further detail below, the cemented carbide substrate 102 includes a cementing constituent concentration that is non-homogenous, but that exhibits a smooth, substantially continuous concentration gradient providing relatively higher cementing constituent concentration within one portion (e.g., at or near a center) of the substrate and a relatively lower cementing constituent concentration within another portion (e.g., at or near an outer lateral surface) of the substrate. The at least one layer 302 including diamond particles may be positioned adjacent to the interfacial surface 104 of the cemented carbide substrate 102. The at least one layer 302 includes a plurality of diamond particles that may exhibit one or more selected sizes.

The one or more selected sizes may be determined, for example, by passing the diamond particles through one or more sizing sieves or by any other method. In an embodiment, the plurality of diamond particles may include a relatively larger size and at least one relatively smaller size. As used herein, the phrases "relatively larger" and "relatively smaller" refer to particle sizes determined by any suitable method, which differ by at least a factor of two (e.g., 40 μm and 20 μm). More particularly, in various embodiments, the plurality of diamond particles may include a portion exhibiting a relatively larger size (e.g., 100 μm, 90 μm, 80 μm, 70 μm, 60 μm, 50 μm, 40 μm, 30 μm, 20 μm, 15 μm, 12 μm, 10 μm, 8 μm) and another portion exhibiting at least one relatively smaller size (e.g., 30 μm, 20 μm, 10 μm, 15 μm, 12 μm, 10 μm, 8 μm, 4 μm, 2 μm, 1 μm, 0.5 μm, less than 0.5 μm, 0.1 μm, less than 0.1 μm). In an embodiment, the plurality of diamond particles may include a portion exhibiting a relatively larger size between about 40 μm and about 15 μm and another portion exhibiting a relatively smaller size between about 15 μm and 2 μm. The plurality of diamond particles may also include three or more different sizes (e.g., one relatively larger size and two or more relatively smaller sizes) without limitation.

The assembly 300 of the cemented carbide substrate 102 and layer(s) 302 may be placed in a pressure transmitting medium, such as a refractory metal can embedded in pyrophyllite or other pressure transmitting medium. The pressure transmitting medium, including the cemented carbide substrate 102 and the at least one layer 302, may be subjected to an HPHT process using an ultra-high pressure press to create temperature and pressure conditions at which diamond is stable. The temperature of the HPHT process may be at least about 1000° C. (e.g., about 1200° C. to about 1600° C.) and the pressure of the HPHT process may be at least 4.0 GPa (e.g., about 5.0 GPa to about 12.0 GPa, about 5.0 GPa to about 8.0 GPa, or at least about 7.5 GPa) for a time sufficient to sinter the diamond particles to form the PCD table 106 (FIGS. 1A and 1B). Upon cooling from the HPHT process, the PCD table 106 becomes metallurgically bonded to the cemented carbide substrate 102. In some embodiments, the PCD table 106 may be leached to enhance the thermal stability thereof, as previously described with respect to FIG. 2. If desired, the leached region may be infiltrated with a desired infiltrant.

U.S. Pat. No. 7,866,418 incorporated herein, in its entirety, by this reference discloses PCD tables and associated PDCs formed under conditions in which enhanced diamond-to-diamond bonding occurs. Such enhanced diamond-to-diamond bonding is believed to occur as a result of the sintering pressure (e.g., at least about 7.5 GPa cell pressure) employed during the HPHT process being further into the diamond stable region, away from the graphite-diamond equilibrium line.

PCD sintered at such elevated pressures may exhibit associated coercivity and magnetic saturation characteristics. For example, according to an embodiment, the PCD (e.g., an unleached portion of the PCD table 106 shown in FIG. 1A) may exhibit a coercivity of 115 Oe or more, a specific magnetic saturation of about 15 $G \cdot cm^3/g$ or less, or both. In a more detailed embodiment, the coercivity of the PCD (e.g., an unleached portion of the PCD table 106 shown in FIG. 1A) may be about 115 Oe to about 250 Oe and the specific magnetic saturation of the PCD may be greater than 0 $G \cdot cm^3/g$ to about 15 $G \cdot cm^3/g$. In an even more detailed embodiment, the coercivity of the PCD (e.g., PCD table 106 shown in FIG. 1A) may be about 115 Oe to about 175 Oe and the specific magnetic saturation of the PCD (e.g., an unleached portion of the PCD table 106 shown in FIG. 1A) may be about 5 $G \cdot cm^3/g$ to about 15 $G \cdot cm^3/g$. In yet an even more detailed embodiment, the coercivity of the PCD may be about 155 Oe to about 175 Oe and the specific magnetic saturation of the PCD may be about 10 $G \cdot cm^3/g$ to about 15 $G \cdot cm^3/g$. The specific permeability (i.e., the ratio of specific magnetic saturation to coercivity) of the PCD may be about 0.10 or less, such as about 0.060 to about 0.090. Other embodiments for the magnetic properties of the PCD so formed may be found in U.S. Pat. No. 7,866,418, which was previously incorporated by reference.

During the HPHT process, the cementing constituent from the cemented carbide substrate 102 may liquefy and infiltrate into the diamond particles of the at least one layer 302. The infiltrated cementing constituent functions as a catalyst that catalyzes formation of directly bonded-together diamond grains to sinter the diamond particles so that the PCD table 106 is formed. In an embodiment tungsten carbide, tungsten, or other particles of substrate 102 may also be swept with the cementing constituent (e.g., cobalt) into the at least one layer 302.

Figure 4:
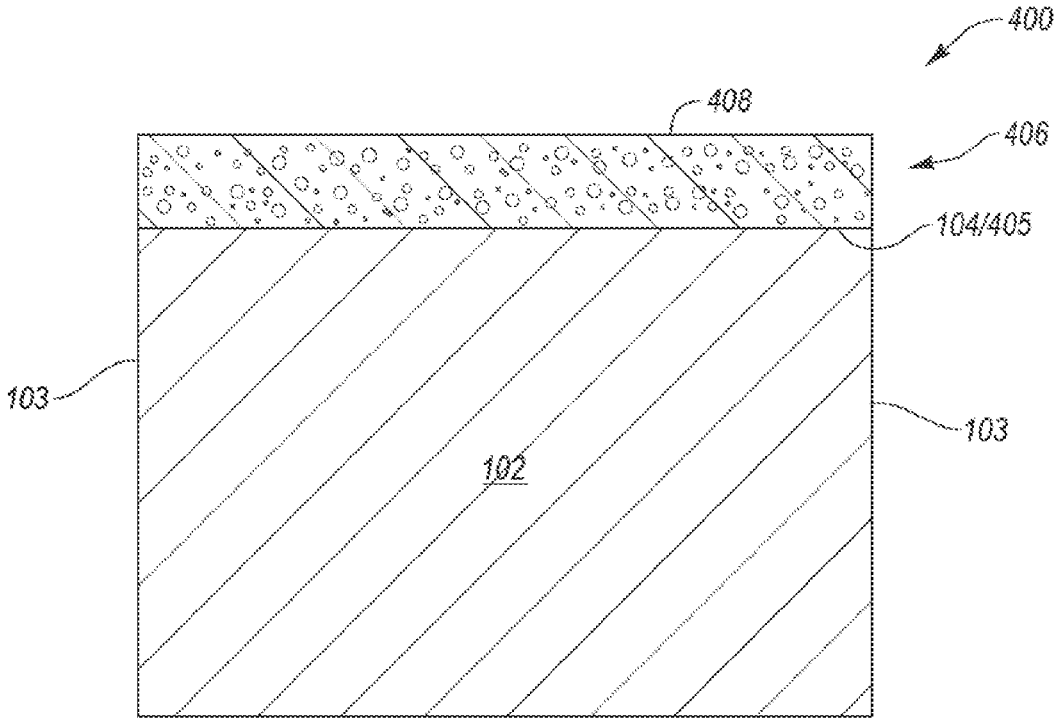
FIG. 4 is a cross-sectional view of an assembly to be HPHT processed to form the PDC shown in FIGS. 1A and 1B according to another embodiment of method.

FIG. 4 is a cross-sectional view of an assembly 400 to be HPHT processed to form the PDC 100 shown in FIGS. 1A and 1B according to another embodiment. In the method described with respect to FIG. 4, the plurality of un-sintered diamond particles in the at least one layer 302 is replaced with another type of diamond volume.

The assembly 400 includes an at least partially leached PCD table 406 including an upper surface 408 and an interfacial surface 405. The at least partially leached PCD table 406 includes a plurality of directly bonded-together diamond grains exhibiting diamond-to-diamond bonding therebetween (e.g., $sp^3$ bonding). The plurality of directly bonded-together diamond grains define a plurality of interstitial regions. The interstitial regions form a network of at least partially interconnected pores that enable fluid to flow from the upper surface 408 to the interfacial surface 405. The at least partially leached PCD table 406 is positioned so that the interfacial surface 405 thereof is positioned adjacent to an interfacial surface 104 of a cemented carbide substrate 102. Similar as to described above, the cemented carbide substrate 102 includes a carbide constituent cemented with a cementing constituent in which the cementing constituent exhibits a substantially continuous concentration gradient, so that one portion (e.g., at or near a center) of the substrate has a different cementing constituent concentration than another portion (e.g., at or near an outer lateral surface) of substrate 102.

The at least partially leached PCD table 406 may be formed by HPHT sintering a plurality of diamond particles having any of the aforementioned diamond particle size distributions in the presence of a metal-solvent catalyst (e.g., iron, nickel, cobalt, or alloys thereof) under any of the disclosed diamond-stable HPHT conditions. For example, the metal-solvent catalyst may be infiltrated into the diamond particles from a metal-solvent-catalyst disc (e.g., a cobalt disc), infiltrated from a cobalt-cemented tungsten carbide substrate, mixed with the diamond particles, or combinations of the foregoing. At least a portion of or substantially all of the metal-solvent catalyst may be removed from the sintered PCD body by leaching as described above.

The assembly 400 of the at least partially leached PCD table 406 and the cemented carbide substrate 102 may be placed in a pressure transmitting medium, such as a refractory metal can embedded in pyrophyllite or other pressure transmitting medium. The pressure transmitting medium, including the assembly 400, may be subjected to an HPHT process to create temperature and pressure conditions at which diamond is stable, as described above. During the HPHT process, the cementing constituent in cemented carbide substrate 102 liquefies and infiltrates into the at least partially leached PCD table 406. Upon cooling, the infiltrated PCD table (also referred to as a preformed PCD table) represented as the PCD table 106 in FIGS. 1A and 1B becomes bonded to the cemented carbide substrate 102.

U.S. patent application Ser. No. 13/648,913 incorporated herein, in its entirety, by reference discloses PDCs and methods of manufacture in which an at least partially leached PCD table is infiltrated with an alloy infiltrant comprising a cobalt-based alloy infiltrant, a nickel-based alloy infiltrant, or combinations thereof (e.g., having a composition at or near a eutectic composition). For example, the alloy infiltrant may include at least one eutectic forming constituent, such as carbon, silicon, boron, phosphorus, cerium, tantalum, niobium, molybdenum, antimony, tin, titanium, carbides thereof, and combinations thereof. By decreasing the melting temperature or temperature range of the alloy infiltrant, a viscosity of the alloy infiltrant is lower as compared to a viscosity of pure cobalt or pure nickel at any given processing temperature and pressure. The lower viscosity promotes more uniform infiltration into the at least partially leached PCD table, and resulting improved bonding between the PCD table and the substrate. Such alloy infiltrant may constitute the cementing constituent of the cemented carbide substrate 102 and/or may be provided from another source, such as a thin disc of the alloy infiltrant.

Characteristics of cemented carbide substrate 102, such as carbon content, carbide grain size, or combinations thereof may be selected to ensure that even upon HPHT processing and liquification of the cementing constituent, the desired concentration gradient of the cementing constituent is maintained. While one might expect the cementing constituent to migrate from a region of high concentration to a region of low concentration when the cementing constituent liquefies (which would remove the concentration gradient, resulting in a substantially homogenous concentration throughout the entire substrate 102), this can be avoided by ensuring that the substrate does not include a homogenous carbon content and/or homogenous carbide grain size throughout the entire substrate. For example, upon liquification of the cementing constituent, the cementing constituent tends to migrate from regions of greater carbide grain size to regions of smaller carbide grain size. Similarly, upon liquification of the cementing constituent, the cementing constituent tends to migrate from regions of relatively higher carbon content to regions of relatively lower carbon content. Thus, by providing and maintaining such carbide grain size and/or carbon content differences, a concentration gradient of the cementing constituent may be maintained or even created during HPHT processing.

In an embodiment, the HPHT process conditions may be controlled so that the cementing constituent from the cemented carbide substrate 102 only partially infiltrates the at least partially leached PCD table 406 to form a first region remote from the cemented carbide substrate 102 in which the interstitial regions thereof remain substantially unfilled by the cementing constituent. The distance that the cementing constituent infiltrates into the at least partially leached PCD table 406 may be controlled by selecting the pressure, temperature, and process time employed in the HPHT process. In an embodiment, the assembly 400 may be subjected to a temperature of about 1150° C. to about 1300° C. (e.g., about 1270° C. to about 1300° C.) and a corresponding pressure that is within the diamond stable region, such as about 5.0 GPa. Such temperature and pressure conditions are lower than temperature and pressure conditions typically used to fully infiltrate the at least partially leached PCD table 406.

In other embodiments, the cementing constituent from the cemented carbide substrate 102 substantially infiltrates the at least partially leached PCD table 406 so that substantially all of the interstitial regions are infiltrated and filled by the cementing constituent from the cemented carbide substrate 102. If desired, after infiltrating and bonding the at least partially leached PCD table 406 to the cemented carbide substrate 102, the cementing constituent that occupies the interstitial regions may be at least partially removed in a subsequent leaching process.

Regardless of the method by which a PDC is formed, the cemented carbide substrate 102 includes a concentration gradient in which the cementing constituent does not exhibit a homogenous concentration throughout the entire substrate, but includes a portion of relatively higher cementing constituent concentration and a portion of relatively lower cementing constituent concentration. Such concentration differences are not achieved by providing a substrate formed of two or more portions in which the concentration of cementing constituent is substantially constant within a given portion, but in which the portions include different concentrations. Such a configuration would include an abrupt change or step in concentration at the boundary between such substrate portions. Rather, the concentration gradient exhibits a smooth, substantially continuous change in concentration as one moves radially from a portion of relatively higher cementing constituent concentration (e.g., at or near the longitudinal center) of the substrate to another portion of relatively lower cementing constituent concentration (e.g., at or near outer lateral edge 103) of the substrate.

Figure 5A:
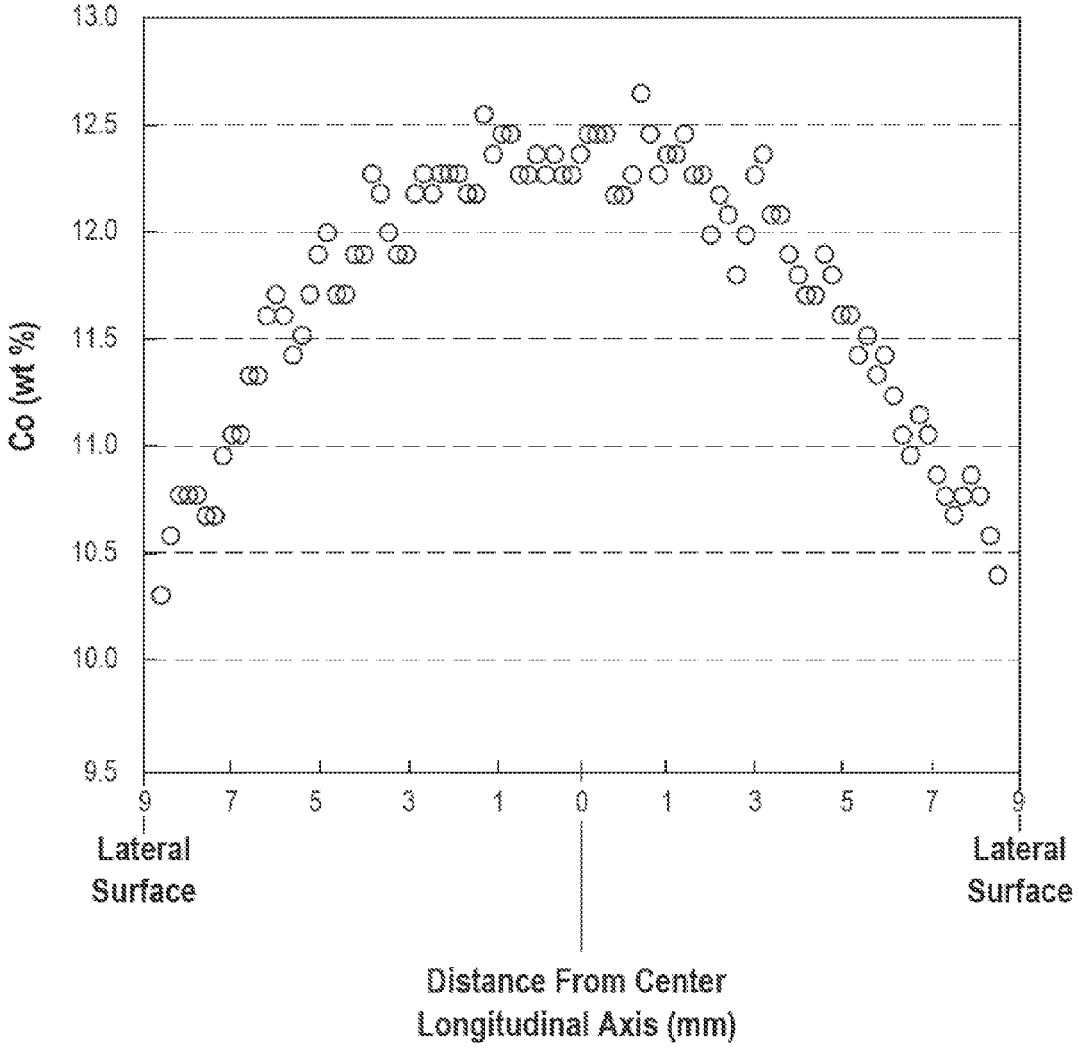
FIG. 5A is a graph showing cobalt concentration relative to radial location within a cobalt cemented tungsten carbide substrate of a PDC exhibiting a substantially continuous cementing constituent concentration gradient across the substrate.

FIG. 5A is an energy dispersive x-ray spectroscopy ("EDAX") plot showing cobalt content through a cobalt-cemented tungsten carbide substrate of an example PDC that was formed where the concentration of the cobalt cementing constituent has a non-homogenous, smoothly sloped, substantially continuous concentration gradient. The substrate has a diameter of about 18 mm so that the longitudinal center of the substrate is at a location about 9 mm from both outer lateral surfaces. The cobalt cementing constituent of the substrate exhibits highest values (e.g., about 12.5% cobalt) at or near the center longitudinal axis of the substrate. The lowest concentration values (e.g., about 10.5% cobalt) are located at or near the outer surface of the substrate. As shown in FIG. 5A, the substrate can be fabricated so as to exhibit no significant abrupt changes in cementing constituent concentration, but rather the concentration gradient may smoothly advance from one region to the other. As shown in FIG. 5A, the concentration gradient of the cementing constituent may exhibit substantial symmetry about the longitudinal axis of the substrate. Such symmetry may be present within a cross-section, as shown. The embodiment shown in FIG. 5A exhibits substantial radial symmetry so as to provide a generally inverted parabolic shape in which the apex of the inverted parabola generally corresponds to the longitudinal axis of the substrate.

Figure 5B:
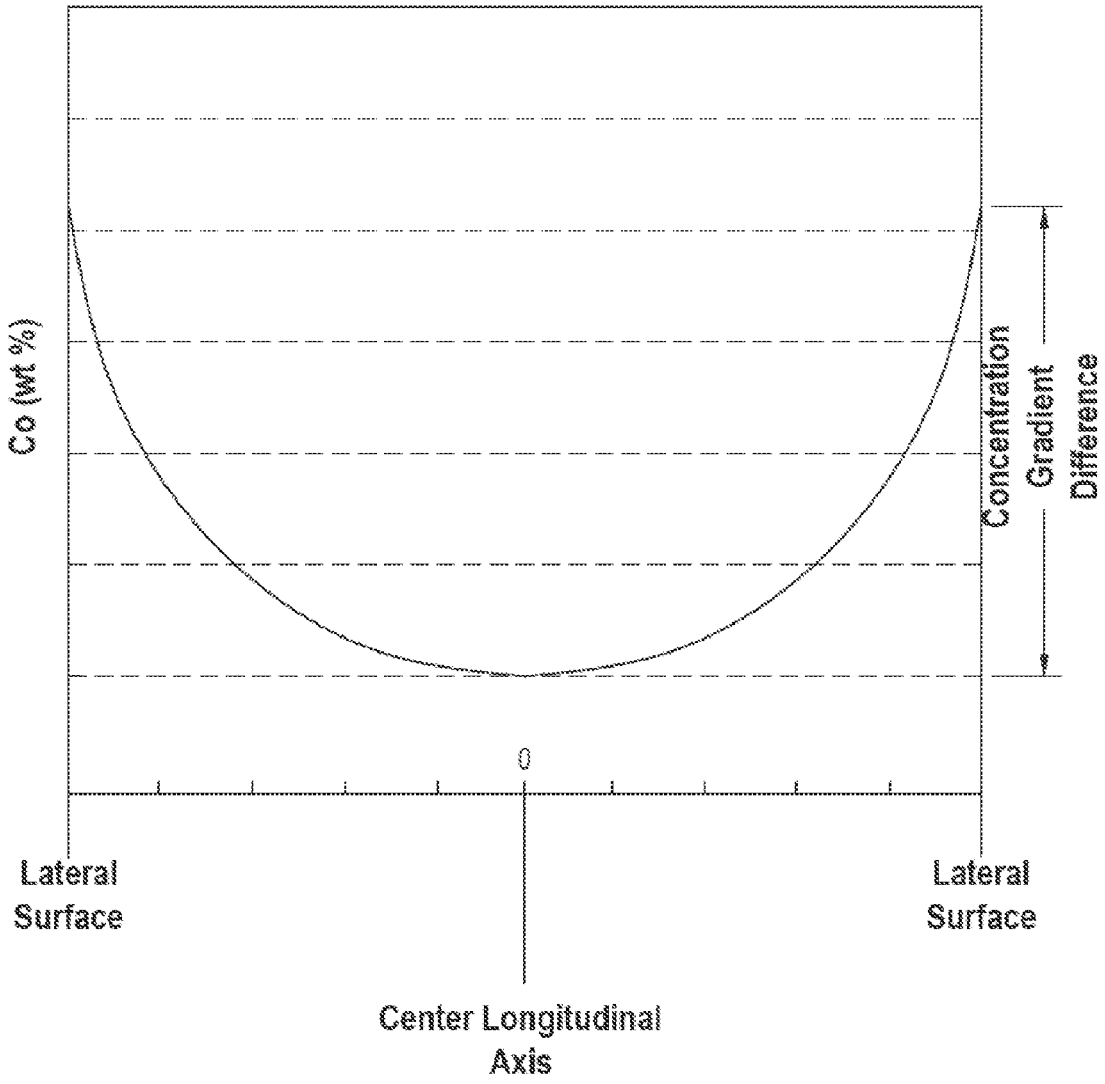
FIG. 5B shows a cementing constituent concentration gradient profile according to another embodiment.
Figure 5C:
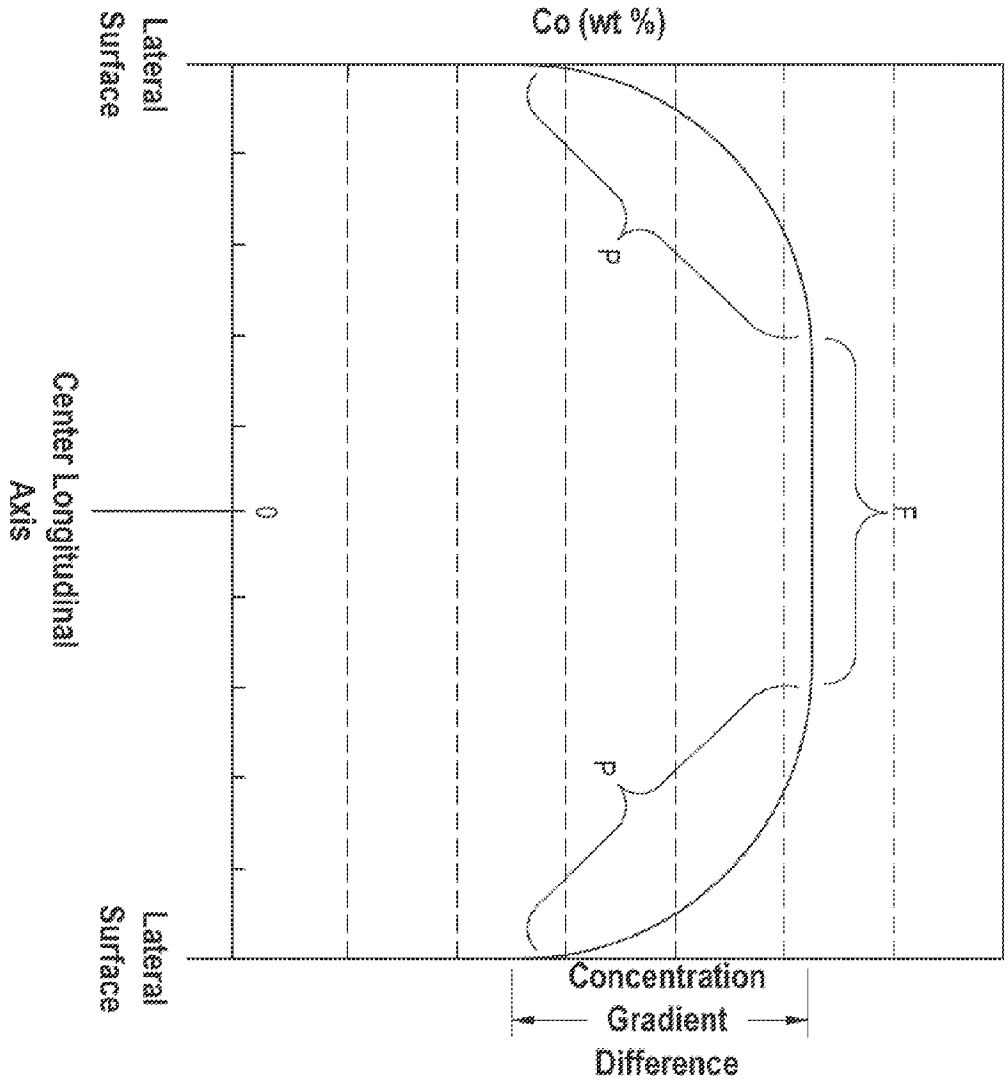
FIG. 5C shows a cementing constituent concentration gradient profile according to another embodiment.
Figure 5D:
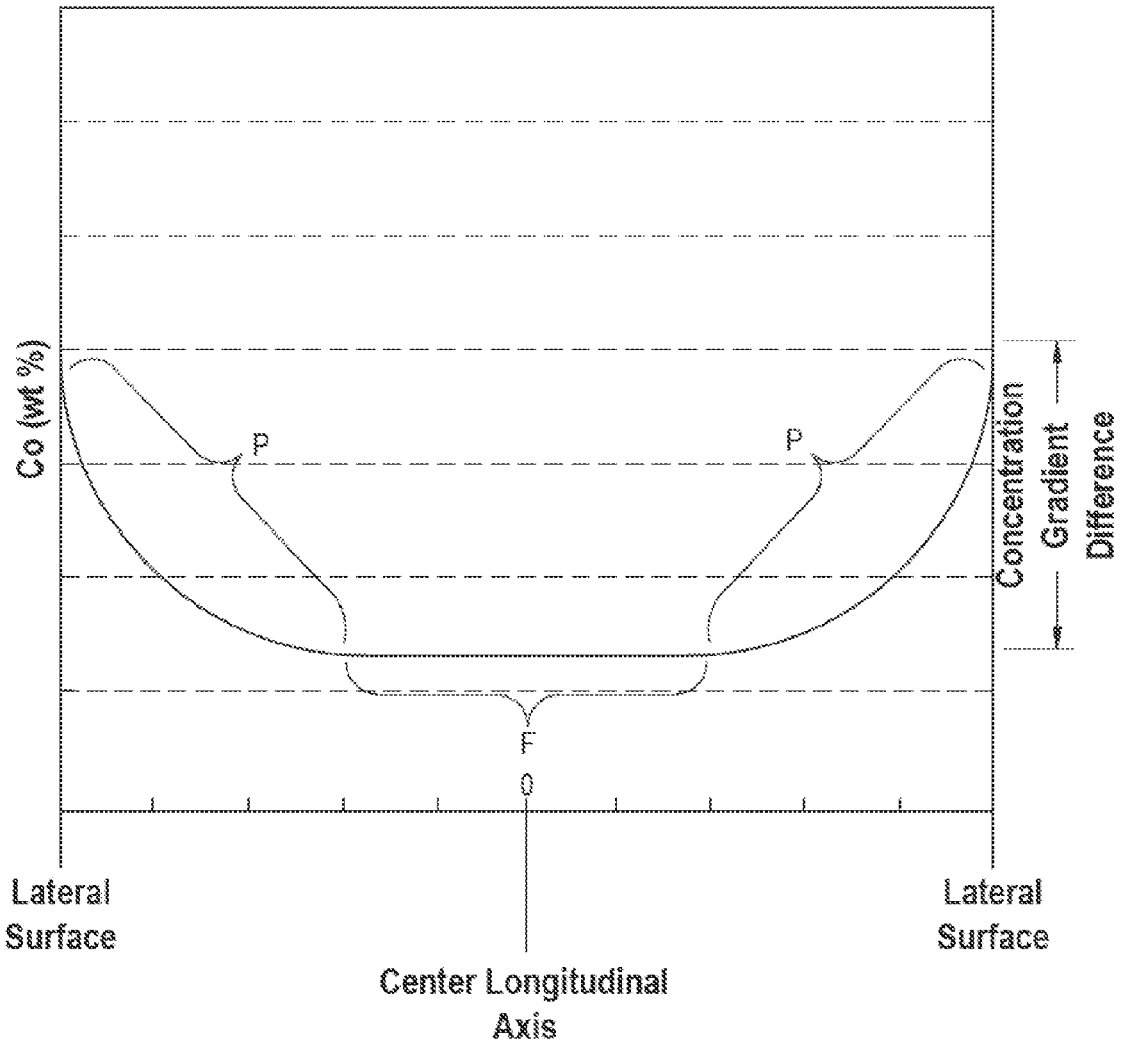
FIG. 5D shows a cementing constituent concentration gradient profile according to another embodiment.
Figure 5E:
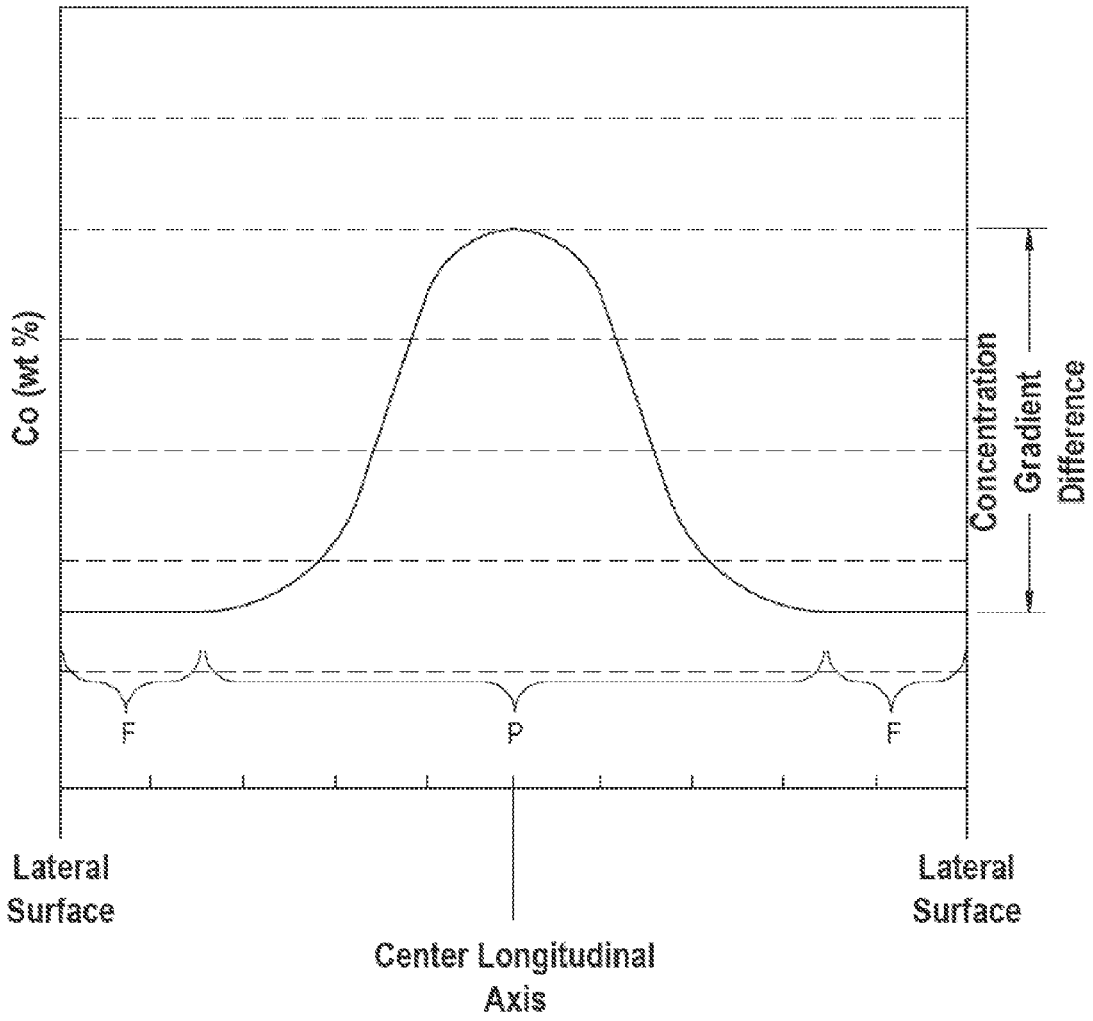
FIG. 5E shows a cementing constituent concentration gradient profile according to another embodiment.

Of course, other concentration gradient profiles are also possible, which may be asymmetric or symmetric. FIGS. 5B-5E illustrate additional embodiments of concentration gradient profiles. FIG. 5B shows a profile that is generally parabolic, so that relatively higher cementing constituent concentration (e.g., cobalt, nickel) is provided at the lateral outer surface, while relatively lower cementing constituent concentration is provided at or near the center longitudinal axis. FIG. 5C shows a profile that includes a generally flat region F adjacent either side of the longitudinal axis, and inverted parabolic transition regions P on either side of region F. FIG. 5D shows a profile that is inverted with respect to that seen in FIG. 5C, in which a relatively higher cementing constituent concentration is provided at the lateral outer surface, and a relatively lower concentration is provided adjacent the longitudinal axis. Because the profile of FIG. 5D includes a generally flat region F, portions of the substrate disposed some given distance away from the longitudinal axis may include substantially the same relatively low cementing constituent concentration as found at the longitudinal center axis. With increasing distance in a radially outward direction towards the lateral outer surface, the cementing constituent concentration begins to increase outside region F and enters transition regions P to either side of region F. FIG. 5E shows another profile, which includes a generally inverted parabolic transition region P adjacent and to either side of the longitudinal axis. Generally flat regions F in which the cementing constituent concentration remains substantially constant are provided adjacent to the lateral outer surface, extending radially inwardly a given distance. In other embodiments, various other concentration profiles may also be provided, as desired, that depart from an at least partially generally parabolic or inverted generally parabolic shape.

In an embodiment, a concentration at or near the center of the substrate may range about 11.5% to about 13.5% cobalt by weight and the concentration of the cementing constituent at or near the outer surface may range about 10% to about 11.5% cobalt by weight. Thus, in various embodiments, a concentration of the cementing constituent (e.g., cobalt, nickel, iron, or alloys thereof) at or near the center of the substrate may range about 8% to about 25% (e.g., about 10% to about 15%, about 11% to about 14%, or about 11.5% to about 13.5%) by weight and the concentration of the cementing constituent at or near the outer surface of the substrate may range from about 6% to about 12%, or about 6% to about 11.5% (e.g., about 11% to about 12%) by weight. For example, the concentration of the cementing constituent at or near the center of the substrate may be at least about 1.2 (e.g., about 1.2 to about 2.0, or about 1.2 to about 1.5) times that of the concentration of the cementing constituent at or near the outer surface of the substrate. In another example, the cementing constituent concentration at the outer lateral surface may be at least about 2% less than the cementing constituent concentration at the center, such as at least about 3% less or about 2% to about 5% less than the cementing constituent concentration at the center.

While FIG. 5A illustrates a configuration where higher cobalt concentrations are found at or near a center of the substrate and lower concentration at or near the outer lateral surface, it will be understood that various other configurations may also be possible. For example, another embodiment may include a relatively lower concentration of the cementing constituent at or near a center of the substrate, with a relatively higher concentration at or near the outer lateral surface of the substrate. Such an embodiment may be beneficial where the outer surface is to be brazed (e.g., for mounting to a drill bit structure, a bearing ring, etc.), as it can sometimes be difficult to achieve the desired brazed mounting where the cobalt or other cementing constituent concentration is too low. For example, in various embodiments, a concentration of the cementing constituent (e.g., cobalt, nickel, iron, or alloys thereof) at or near the center of the substrate may range about 5% to about 15%, about 10% to about 15%, or about 6% to about 12% (e.g., about 11% to about 12%) by weight and the concentration of the cementing constituent at or near the outer surface may range about 8% to about 25%, about 6% to about 11.5%, or about 10% to about 15% (e.g., about 11% to about 14%, or about 11.5% to about 13.5%) by weight. For example, the concentration of the cementing constituent at or near the outer surface of the substrate may be at least about 1.2 (e.g., about 1.2 to about 2.0, or about 1.2 to about 1.5) times that of the concentration of the cementing constituent at or near the center of the substrate. In another example, the cementing constituent concentration at the center of the substrate may be at least about 2% less than the cementing constituent concentration at the outer surface, such as at least about 3% less or about 2% to about 5% less than the cementing constituent concentration at the outer surface.

It will be appreciated that a configuration such as that illustrated in FIG. 5A may provide substantially uniform (e.g., about 10.5 to about 11 weight %) cobalt or other cementing constituent concentration about the outer lateral surface, while the upper surface (e.g., interface surface 104 of FIGS. 1-4) of the substrate may include relatively higher cementing constituent concentration at the center, and which concentration gradually decreases as one moves radially outward from the center towards the outer lateral surface. The concentration profile of the cross-section through the center of the substrate (or across the upper surface 104) may generally be in the shape of an inverted parabola, with the concentration apex generally near the longitudinal axis. The opposite bottom surface may include a similar concentration profile.

Another configuration may include a core portion within the substrate having a relatively higher (or lower) cementing constituent concentration, where the core portion is completely surrounded by a portion having relatively lower (or higher) cementing constituent concentration. In other words, the upper and lower surfaces may exhibit the same relatively lower cementing constituent concentration exhibited by the outer lateral surfaces. Another configuration may reverse the concentration profile (i.e., lower concentration within a fully surrounded core, and relatively higher concentration at all outer surfaces). In such embodiments, the concentration profile through a cross-section through the center of the substrate may be generally that of an inverted parabola or a parabola (e.g., FIG. 5A or 5B) in which the concentration increases or decreases generally parabolically (or as an inverted parabola). Other concentration profiles are shown in FIGS. 5B-5E as described above. For example, in some embodiments, the concentration profile may include a substantially flat region in which for a given distance, the concentration of cementing constituent remains substantially constant (e.g., see FIGS. 5C-5E).

A desired concentration gradient in the cemented carbide substrate may be achieved by any suitable method. According to an embodiment, a concentration gradient may be created within the substrate by initially providing two or more portions of a "green" substrate assembly that exhibit differences in the carbide constituent grain size and/or carbon content. For example, graphite powder or other carbon source may be mixed with the carbide grains and cementing constituent (e.g., cobalt powder) to increase the carbon content relative to another portion of the substrate assembly. In an embodiment, carbide constituent grain size may be about 0.1 μm to about 50 μm, about 0.2 μm to about 25 μm, about 0.5 μm to about 10 μm, about 0.8 μm to about 5 μm, or about 1 μm to about 4 μm. Of course, one portion of the "green" substrate assembly may exhibit a larger carbide grain size, while another portion of the "green" substrate assembly exhibits a smaller carbide grain size. In an embodiment, one portion may have a carbide grain size about 0.5 μm to about 3 μm, while another portion may have a carbide grain size about 2 μm to about 10 μm. In an embodiment, carbon content may be about 1 weight percent to about 15 weight percent, about 2 weight percent to about 10 weight percent, about 3 weight percent to about 8 weight percent, about 4.2 weight percent to about 6.2 weight percent, or about 4 weight percent to about 6 weight percent. Of course, one portion of the "green" substrate assembly may exhibit a higher carbon content, while another portion of the "green" substrate assembly exhibits a lower carbon content. In an embodiment, one portion may have a carbon content about 3 weight percent to about 5 weight percent, while another portion may have a carbon content about 5 weight percent to about 8 weight percent.

As described above, these factors affect liquid phase migration of the cementing constituent when the substrate is sintered at high temperature (e.g., about 1400° C.) or in an HPHT process. A concentration gradient may be induced in the cementing constituent, even where the initial preformed portions of the substrate include equal cementing constituent concentrations so long as the different portions include different carbide constituent grain sizes and/or carbon content.

Figure 6A:
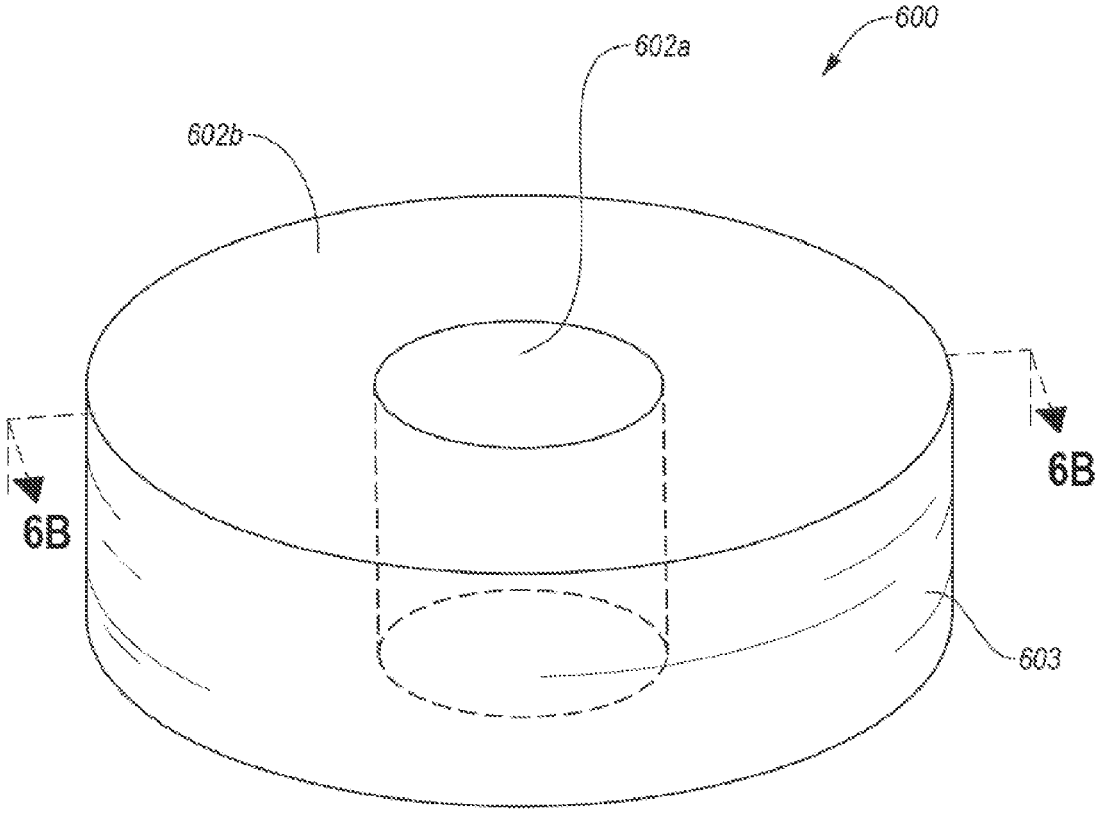
FIG. 6A is an isometric view of a substrate assembly that may be sintered to form a substrate having a cementing constituent concentration gradient as shown in FIG. 5A.
Figure 6B:
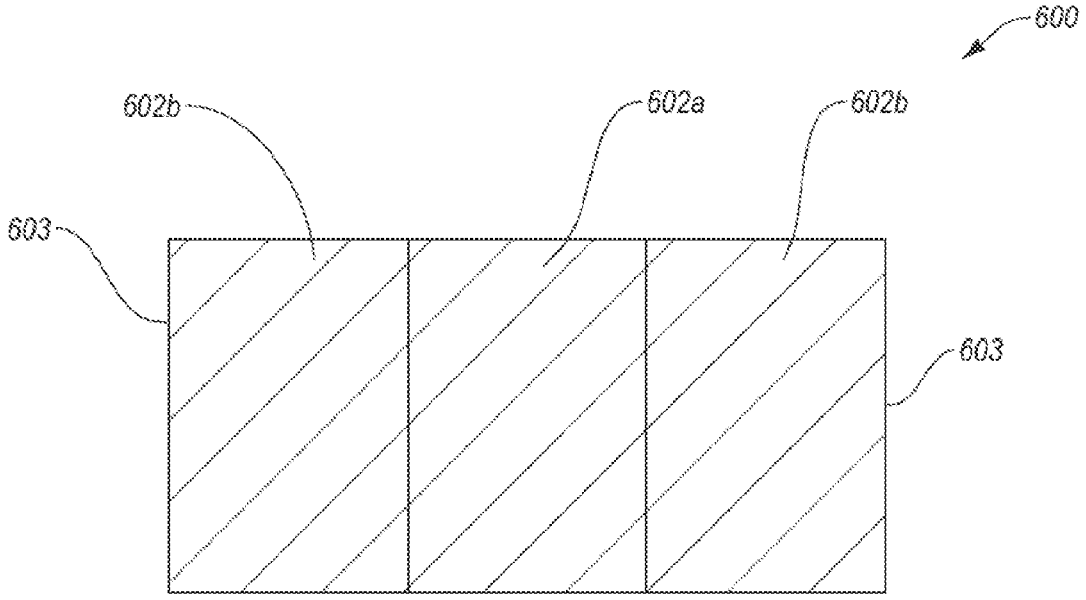
FIG. 6B is a cross-sectional view of the assembly of FIG. 6A.

FIGS. 6A and 6B are isometric and cross-sectional views, respectively, of an embodiment of a substrate assembly 600 that may be sintered at high temperature to result in a substrate 602 (FIG. 6C) with a cementing constituent having a non-homogenous, substantially continuous concentration gradient. The substrate assembly 600 may include two preformed portions, 602*a* and 602*b*. The central core portion 602*a* is disposed within a "doughnut hole" center of surrounding outer annular portion 602*b*. Prior to sintering, the portions 602*a* and 602*b* may be separate from one another, and may differ in carbide constituent grain size, carbon content, or both. For example, any of the carbide gains disclosed herein may be used, such as tungsten carbide, titanium carbide, chromium carbide, niobium carbide, tantalum carbide, vanadium carbide, or combinations thereof. The portions 602*a* and 602*b* may initially include the same or different cementing constituent (e.g., cobalt, nickel, iron, or alloys thereof) concentrations.

It has been found that upon sintering, when the cementing constituent liquefies, the liquid cementing constituent tends to migrate from a region of larger carbide constituent grains to a region of smaller carbide constituent grains. Similarly, the liquid cementing constituent tends to migrate from a region of higher carbon content to a region of lower carbon content. Thus, even where the cementing constituent is initially present at the same homogenous concentration across both of the portions 602*a* and 602*b* (e.g., both at about 12% by weight), a concentration gradient may be induced when the substrate assembly 600 is sintered. Upon sintering, the liquid cementing constituent migrates unevenly, resulting in the desired gradient.

In addition, upon sintering the separate portions may become fused together as a result of liquification and resolidification of the cementing constituent, resulting in a single integral substrate. In other words, the two substrate assembly portions (or more than two portions, should that be the case) are sintered together to form a single integral substrate. The resulting substrate 602 (FIG. 6C) may exhibit a smooth, substantially continuous, gradually changing cementing constituent concentration (e.g., as shown in any of FIGS. 5A-5E). The concentration gradient is generally smooth, without any abrupt change or step in concentration as one moves from a region of relatively high (or low) cementing constituent concentration to a region of relatively lower (or higher) cementing constituent concentration. The cross-sectional cementing constituent concentration profile may be at least partially generally parabolic (or inverted at least partially generally parabolic), or may include one or more generally parabolic (or inverted generally parabolic) transition regions. As described above, this may be achieved even where the preformed assembly 600 is configured so that core portion 602*a* initially has a higher or lower cementing constituent concentration than outer portion 602*b*.

By way of example, in order to induce a concentration gradient as shown in FIG. 5A, in which higher cementing constituent concentrations are found at or near a center of the substrate 602 and relatively lower cementing constituent concentrations are found at or near outer lateral surface 603, the core portion 602*a* may include a lower carbon content than outer portion 602*b*. In an embodiment, the core portion 602*a* may include an excess of tungsten or another carbide forming element, while outer portion 602*b* may include a lower amount of excess carbide forming element, a stoichiometric amount of carbide forming element, or an excess of carbon relative to stoichiometric requirements of tungsten carbide or another carbide. Because the core portion has a lower carbon content, the cementing constituent will tend to migrate towards the core portion, from the outer portion, resulting in a cementing constituent concentration gradient similar to that shown in FIG. 5A.

In another embodiment, a similar result may be obtained by providing core portion 602*a* with relatively smaller carbide grain size as compared to the carbide grain size of outer portion 602*b*. Upon sintering, the liquefied cementing constituent will tend to migrate towards the core portion, from the outer portion, resulting in a cementing constituent concentration gradient similar to that shown in FIG. 5A. Another embodiment may employ differences in both carbide grain size and carbon content to induce the desired concentration gradient upon sintering.

Differently configured concentration gradients may be created within the substrate through the above-described principles. For example, in order to produce the opposite concentration gradient, with lower cementing constituent concentration at or near the center, and relatively higher cementing constituent concentration at or near outer lateral surface 603, one may reverse the carbon content and/or carbide grain size characteristics (e.g., core portion 602*a* may have higher carbon content and/or larger carbide grain size as compared to outer portion 602*b*). Upon sintering, such a configuration would exhibit a concentration gradient that would be similar to that shown in FIG. 5B. Various other configurations may also be provided based on the described principles. For example, in order to produce a substantially flat concentration region F such as that shown in any of FIGS. 5C-5E, a region may be provided within the green substrate corresponding to region F that does not include carbon content and/or carbide grain size gradients within the region corresponding to region F. Upon sintering, the resulting region of the substrate would exhibit a region F including substantially constant cementing constituent concentration across region F.

Figure 6C:
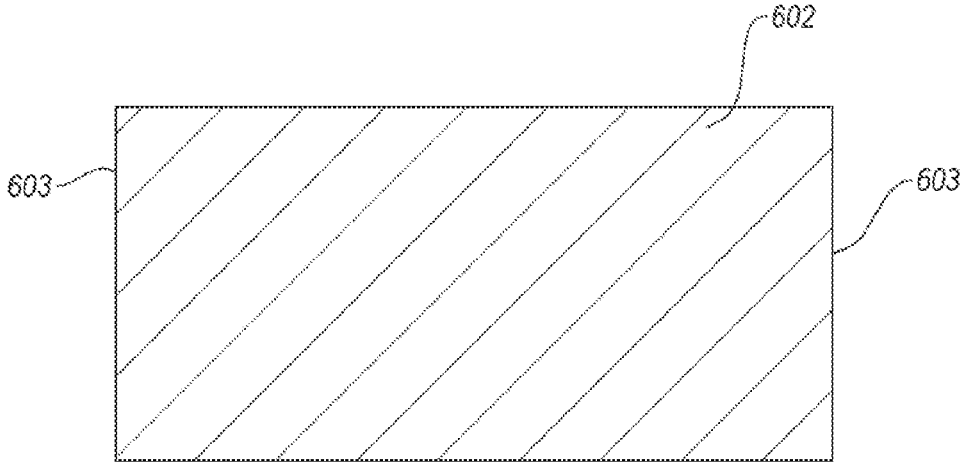
FIG. 6C is a cross-sectional view of a substrate resulting after sintering the substrate assembly of FIGS. 6A and 6B.

Once a substrate as shown in FIG. 6C is formed, it may be attached to a leached PCD table as shown in FIG. 4 or an unleached PCD table as shown in FIG. 1B. Where the table is unleached, the PCD table may be leached after attachment, as in FIG. 2. In another embodiment, once a substrate as shown in FIG. 6C is formed, one or more layers of diamond particles may be positioned thereon and sintered, as described in conjunction with FIG. 3.

Figure 7:
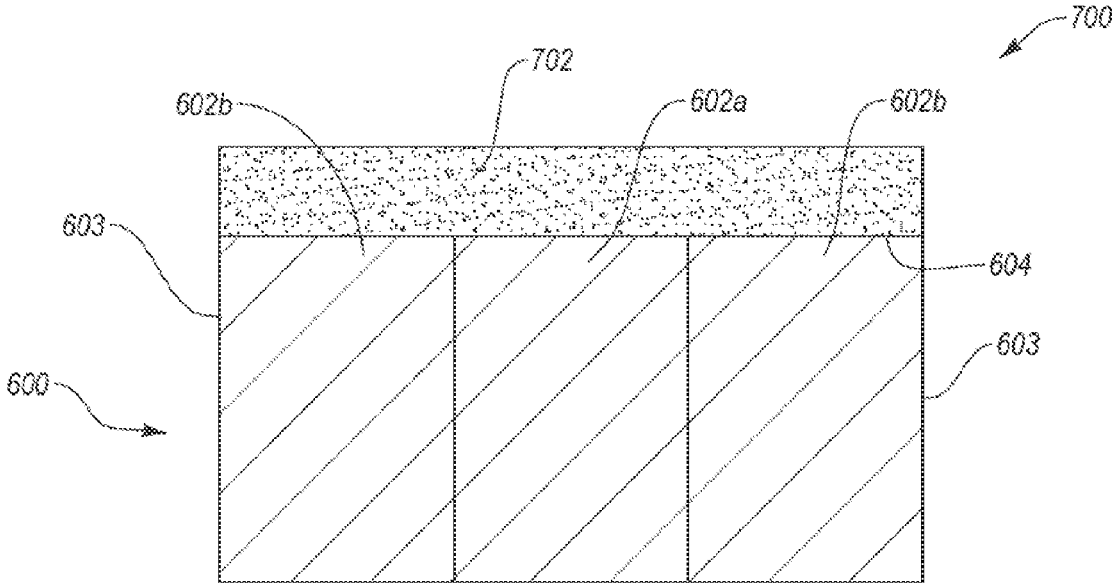
FIG. 7 is a cross-sectional view of a substrate assembly and one or more layers of diamond particles that can be HPHT processed to form the PDC shown in FIGS. 1A and 1B according to an embodiment.

In another embodiment, sintering of substrate assembly 600 may occur in the same step as metallurgical bonding and/or sintering of a PCD table to the resulting substrate 602. FIG. 7 shows an embodiment sharing characteristics with the embodiments of FIG. 3 and FIG. 6B. An assembly 700 including the substrate assembly 600, including substrate portions 602*a* and 602*b* as described in conjunction with FIGS. 6A and 6B is provided, and one or more layers 702 of diamond particles are positioned adjacent to surface 604 of substrate assembly 600. Upon HPHT processing, the substrate assembly 600 is sintered to result in a substrate 602 (e.g., as shown in FIG. 6C), while diamond particles 702 are sintered and bonded to the substrate 602 in the same process. Such a single-step process may achieve sintering of substrate portions 602*a* and 602*b*, while also sintering the plurality of diamond particles 702 into an integrally formed PCD table and metallurgically bonding the PCD table to substrate 602.

Figure 8:
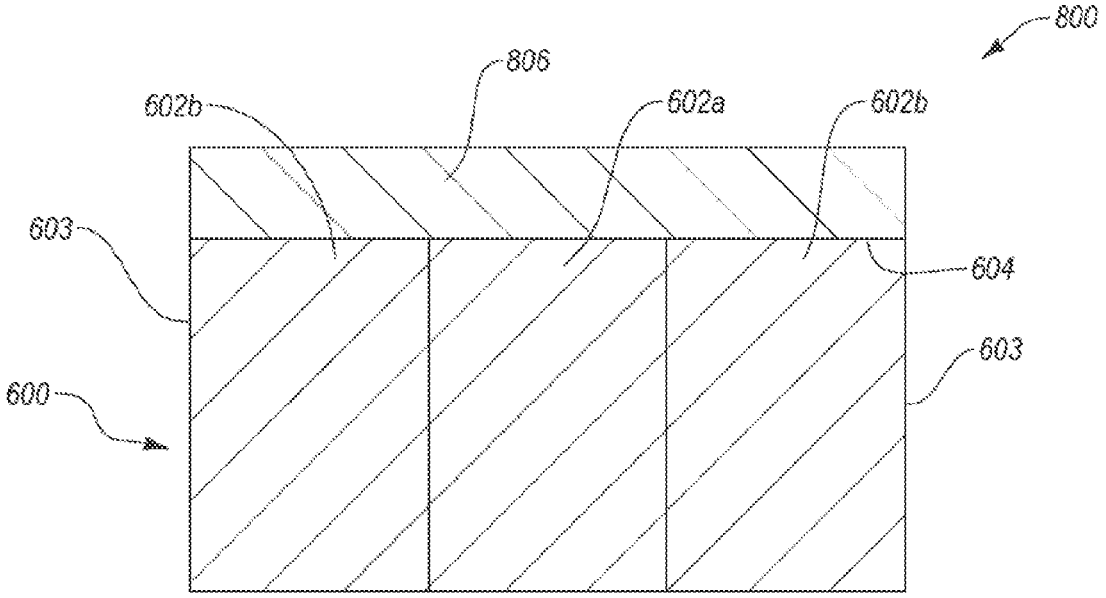
FIG. 8 is a cross-sectional view of a substrate assembly and a preformed PCD table that can be HPHT processed to form the PDC shown in FIGS. 1A and 1B according to another embodiment.

FIG. 8 shows another embodiment, which shares characteristics with the embodiments of FIG. 4 and FIG. 6B. An assembly 800 including substrate assembly 600, including substrate portions 602*a* and 602*b* is provided, and a previously sintered PCD table 806 is positioned adjacent surface 604 of substrate assembly 600. Upon HPHT processing, the substrate assembly 600 is sintered to result in the substrate 602 (e.g., as shown in FIG. 6C), while the PCD table 806 is metallurgically bonded to substrate 602 in the same HPHT process. If the PCD table 806 is porous and at least partially leached, the PCD table 806 may be infiltrated with cementing constituent from the substrate 602 or substrate assembly. The PCD tables formed by any method disclosed herein may be leached (e.g., before or after bonding to substrate 602), as desired.

Figure 9A:
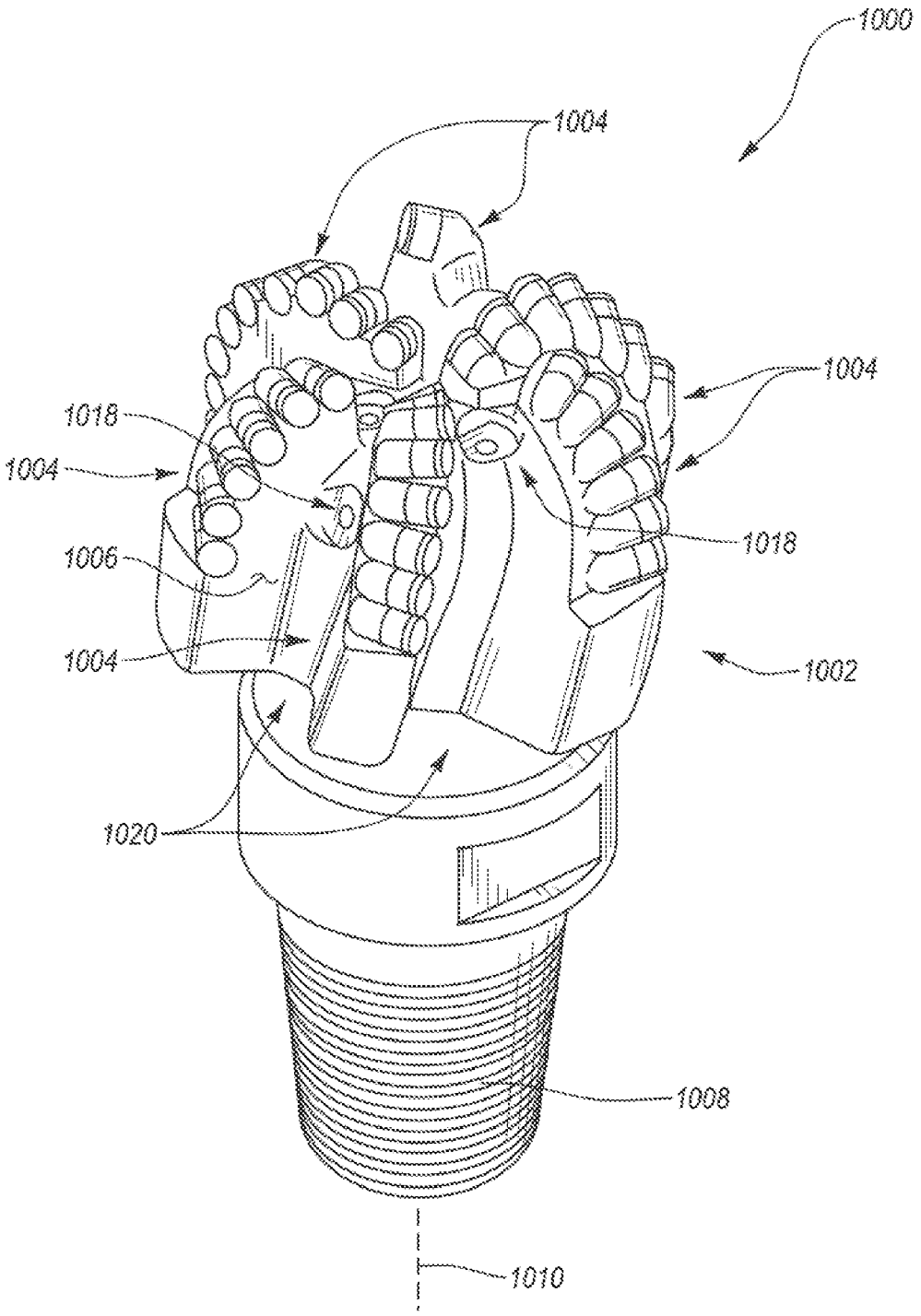
FIG. 9A is an isometric view of an embodiment of a rotary drill bit that may employ one or more of the disclosed PDC embodiments.
Figure 9B:
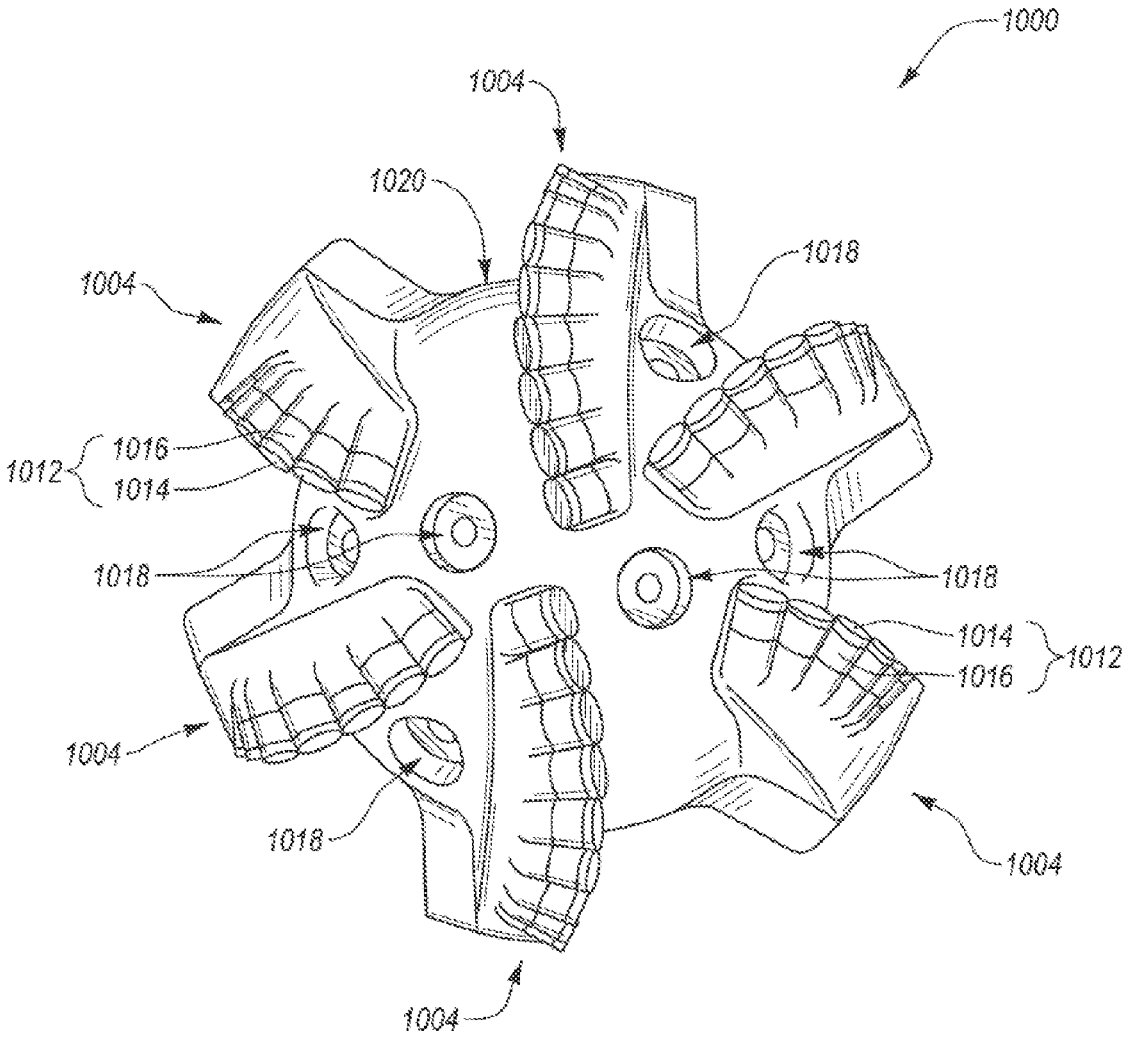
FIG. 9B is a top elevation view of the rotary drill bit shown in FIG. 9A.

FIG. 9A is an isometric view and FIG. 9B is a top elevation view of an embodiment of a rotary drill bit 1000. The rotary drill bit 1000 includes at least one PDC configured according to any of the previously described PDC embodiments, such as the PDC 100 of FIGS. 1A and 1B. The rotary drill bit 1000 may include a bit body 1002 that may include radially and longitudinally-extending blades 1004 having leading faces 1006, and a threaded pin connection 1008 for connecting the bit body 1002 to a drilling string. The bit body 1002 defines a leading end structure for drilling into a subterranean formation by rotation about a longitudinal axis 1010 and application of weight-on-bit. At least one PDC, configured according to any of the previously described PDC embodiments, may be affixed to the bit body 1002. With reference to FIG. 9B, a plurality of PDCs 1012 are secured to the blades 1004 of the bit body 1002 (FIG. 9A). For example, each PDC 1012 may include a PCD table 1014 bonded to a substrate 1016. More generally, the PDCs 1012 may include any PDC disclosed herein, without limitation. In addition, if desired, in some embodiments, a number of the PDCs 1012 may be conventional in construction. Also, circumferentially adjacent blades 1004 define so-called junk slots 1020 therebetween. Additionally, the rotary drill bit 1000 includes a plurality of nozzle cavities 1018 for communicating drilling fluid from the interior of the rotary drill bit 1000 to the PDCs 1012.

FIGS. 9A and 9B merely depict an embodiment of a rotary drill bit that employs at least one PDC fabricated and structured in accordance with the disclosed embodiments, without limitation. The rotary drill bit 1000 is used to represent any number of earth-boring tools or drilling tools, including, for example, core bits, roller-cone bits, fixed-cutter bits, eccentric bits, bicenter bits, reamers, reamer wings, or any other downhole tool including superabrasive compacts, without limitation.

The PDCs disclosed herein (e.g., the PDC 100 shown in FIGS. 1A and 1B) may also be utilized in applications other than cutting technology. For example, the disclosed PDC embodiments may be used in wire dies, bearings, artificial joints, inserts, cutting elements, and heat sinks. Thus, any of the PDCs disclosed herein may be employed in an article of manufacture including at least one superabrasive element or compact.

Thus, the embodiments of PDCs disclosed herein may be used on any apparatus or structure in which at least one conventional PDC is typically used. In an embodiment, a rotor and a stator, assembled to form a thrust-bearing apparatus, may each include one or more PDCs (e.g., the PDC 100 shown in FIGS. 1A and 1B) configured according to any of the embodiments disclosed herein and may be operably assembled to a downhole drilling assembly. U.S. Pat. Nos. 4,410,054; 4,560,014; 5,364,192; 5,368,398; and 5,480,233, the disclosure of each of which is incorporated herein, in its entirety, by this reference, disclose subterranean drilling systems within which bearing apparatuses utilizing superabrasive compacts disclosed herein may be incorporated. The embodiments of PDCs disclosed herein may also form all or part of heat sinks, wire dies, bearing elements, cutting elements, cutting inserts (e.g., on a roller-cone-type drill bit), machining inserts, or any other article of manufacture as known in the art. Other examples of articles of manufacture that may use any of the PDCs disclosed herein are disclosed in U.S. Pat. Nos. 4,811,801; 4,268,276; 4,468,138; 4,738,322; 4,913,247; 5,016,718; 5,092,687; 5,120,327; 5,135,061; 5,154,245; 5,460,233; 5,544,713; 5,180,022; and 6,793,681, the disclosure of each of which is incorporated herein, in its entirety, by this reference.

While various aspects and embodiments have been disclosed herein, other aspects and embodiments are contemplated. The various aspects and embodiments disclosed herein are for purposes of illustration and are not intended to be limiting. Additionally, the words "including," "having," and variants thereof (e.g., "includes" and "has") as used herein, including the claims, shall be open ended and have the same meaning as the word "comprising" and variants thereof (e.g., "comprise" and "comprises").

What is claimed is:

1. A polycrystalline diamond compact, comprising:

a cemented carbide substrate including a carbide constituent cemented with a cementing constituent, the cemented carbide substrate including:

a first portion of the cemented carbide substrate having a first concentration of the cementing constituent; and a second portion of the cemented carbide substrate laterally spaced from the first portion, the second portion having a second concentration of the cementing constituent that is different than the first concentration of the cementing constituent;

wherein the cementing constituent has a concentration exhibiting a substantially continuous concentration gradient between the first portion and the second portion, wherein the substantially continuous gradient is at least partially generally parabolic or at least partially inverted parabolic; and a polycrystalline diamond table bonded to the cemented carbide substrate, the polycrystalline diamond table including a plurality of bonded diamond grains exhibiting diamond-to-diamond bonding therebetween, the plurality of bonded diamond grains defining a plurality of interstitial regions.

2. The polycrystalline diamond compact of claim 1 wherein the cementing constituent includes cobalt.

3. The polycrystalline diamond compact of claim 1 wherein the carbide constituent includes tungsten carbide.

4. The polycrystalline diamond compact of claim 1 wherein the first portion includes a center portion at or near a center of the substrate and the second portion includes an outer portion at or near an outer lateral surface of the substrate.

5. The polycrystalline diamond compact of claim 4 wherein the center portion of the substrate has a higher concentration of the cementing constituent than the outer portion of the substrate.

6. The polycrystalline diamond compact of claim 4 wherein the substantially continuous gradient extends radially so that locations of the substrate that are located at a substantially equal radius from the center of the substrate have approximately equal respective concentrations of the cementing constituent.

7. The polycrystalline diamond compact of claim 4 wherein the cementing constituent includes cobalt, the cobalt having a concentration at the center that is from about 11.5% to about 13.5% by weight.

8. The polycrystalline diamond compact of claim 4 wherein the cementing constituent includes cobalt, the cobalt having a concentration at the outer lateral surface that is from about 6% to about 11.5% by weight.

9. The polycrystalline diamond compact of claim 4 wherein the cementing constituent includes cobalt, the cobalt having a concentration at the center of the substrate that is from about 10% to about 15% by weight and the cobalt has a concentration at the outer lateral surface that is from about 6% to about 11.5% by weight.

10. The polycrystalline diamond compact of claim 1 wherein the polycrystalline diamond table is integrally formed with the substrate or the polycrystalline diamond table is a preformed polycrystalline diamond table.

11. The polycrystalline diamond compact of claim 1 wherein the polycrystalline diamond table includes a leached region from which metal-solvent catalyst has been at least partially depleted.

12. A rotary drill bit comprising:

a bit body including a leading end structure configured to facilitate drilling a subterranean formation; and a plurality of cutting elements mounted to the bit body, at least one of the plurality of cutting elements including:

a cemented carbide substrate including a carbide constituent cemented with a cementing constituent, the cemented carbide substrate including:

a first portion of the cemented carbide substrate having a first concentration of the cementing constituent; and a second portion of the cemented carbide substrate laterally spaced from the first portion, the second portion having a second concentration of the cementing constituent that is different than the first concentration of the cementing constituent;

wherein the cementing constituent concentration exhibits a substantially continuous concentration gradient between the first portion and the second portion, wherein the substantially continuous gradient is at least partially generally parabolic or at least partially inverted parabolic; and a polycrystalline diamond table bonded to the cemented carbide substrate, the polycrystalline diamond table including a plurality of bonded diamond grains exhibiting diamond-to-diamond bonding therebetween, the plurality of bonded diamond grains defining a plurality of interstitial regions.

13. The rotary drill bit of claim 12 wherein the cementing constituent includes cobalt.

14. The rotary drill bit of claim 12 wherein the carbide constituent includes tungsten carbide.

15. The rotary drill bit of claim 12 wherein the first portion includes a center portion at or near a center of the substrate and the second portion includes an outer portion at or near an outer lateral surface of the substrate.

16. The rotary drill bit of claim 15 wherein the center portion of the substrate has a higher concentration of the cementing constituent than the outer portion of the substrate.

17. The rotary drill bit of claim 15 wherein the cementing constituent includes cobalt, the cobalt having a concentration at the center of the substrate that is from about 10% to about 15% and the cobalt has a concentration at the at least one outer lateral surface that is from about 6% to about 11.5%.

* * * * *